US005740637A

United States Patent [19]

Snow

[11] Patent Number: 5,740,637

[45] Date of Patent: Apr. 21, 1998

[54] CREMATION NICHE

[76] Inventor: William L. Snow, 702 Fern St., Anna Maria, Fla. 34216

[21] Appl. No.: 628,461

[22] Filed: Apr. 5, 1996

[51] Int. Cl.[6] ..... E04H 13/00

[52] U.S. Cl. ..... 52/136; 52/135; 52/140; 52/142; 52/603; 27/1; 27/35

[58] Field of Search ..... 52/135, 136, 137, 52/139, 140, 141, 142, 603; 27/1, 19, 35

[56] References Cited

U.S. PATENT DOCUMENTS

| | | | |
|---|---|---|---|
| 1,373,014 | 3/1921 | Moore | 27/1 |
| 1,940,771 | 12/1933 | Prier | 27/1 |
| 3,076,292 | 2/1963 | Arbogast | 52/136 |
| 3,839,768 | 10/1974 | McQuestion | 52/135 X |
| 3,925,944 | 12/1975 | Pickel | 52/136 X |
| 3,983,667 | 10/1976 | Zwick | 52/140 |
| 4,023,316 | 5/1977 | Martin . | |
| 4,476,657 | 10/1984 | Juba et al. | 52/135 X |
| 4,521,999 | 6/1985 | Flanagan . | |
| 4,607,417 | 8/1986 | Hancovsky | 52/137 X |
| 4,669,236 | 6/1987 | Martin . | |
| 4,688,359 | 8/1987 | See . | |
| 5,134,758 | 8/1992 | Christensen | 52/136 X |
| 5,140,728 | 8/1992 | Chandler et al. | 27/35 |
| 5,287,603 | 2/1994 | Schorman | 27/1 |
| 5,349,727 | 9/1994 | Niebergall . | |
| 5,477,594 | 12/1995 | LePage . | |

*Primary Examiner*—Carl D. Friedman
*Assistant Examiner*—Aimee E. McTigue
*Attorney, Agent, or Firm*—Charles J. Prescott

[57] ABSTRACT

A cremation niche for holding the cremated remains of a deceased living being. The cremation niche includes a precast concrete block preferably having a size and consistency of a conventional cast building block. A cavity within the concrete block with access thereinto through an opening in the front upright surface of the concrete block provides access into the cavity for placing the cremated remains therein. A front face block matches the dimensions of the front surface of the concrete block and is connectable thereto by fasteners. A seal between the face block and the front face of the concrete block seals the cavity and protects the cremated remains. A separate molded plastic liner fitted into the cavity further enhances a hermetic seal within the cavity. Spacer tabs formed into one horizontal surface and one end surface of the concrete block enhance ease of building a wall of the filled and sealed niches with precise spacing between niches.

2 Claims, 2 Drawing Sheets

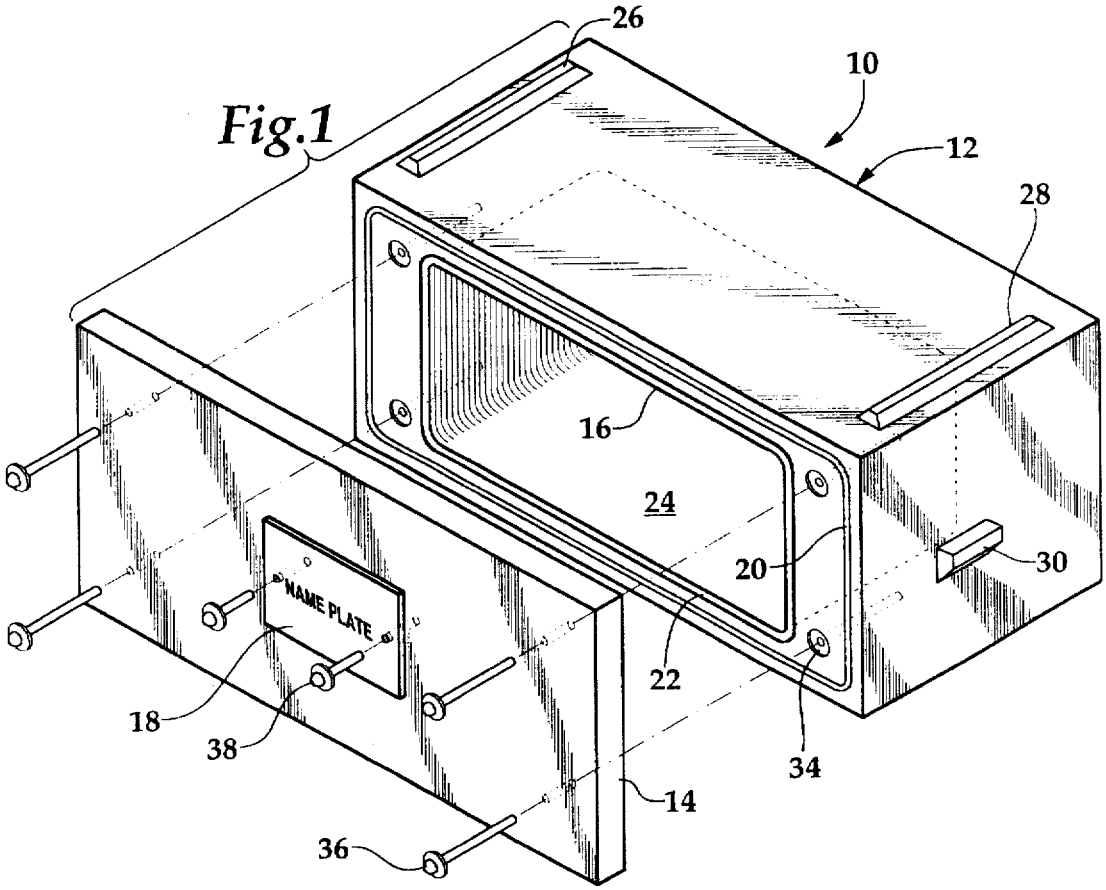
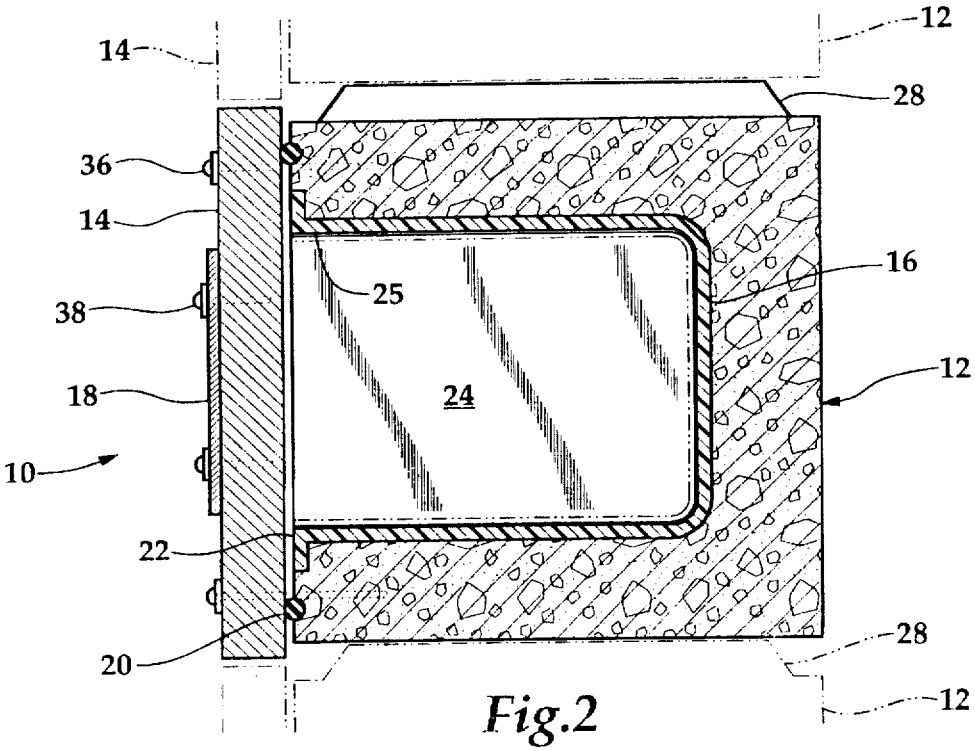
Fig.2

CREMATION NICHE

BACKGROUND OF THE INVENTION

1. Scope of Invention

This invention relates generally to a storage container for the cremated remains of a living being, and more particularly to such a device having a uniform concrete building block configuration, overall size and fabrication.

2. Prior Art

Cremation of the mortal remains of living beings, particularly humans and pets, has become increasingly popular, particularly in light of the cost of conventional funerals and burials. The end product of the cremation process after removal of non-combustible materials and grinding, is a small volume of very finely ground ash.

Disposal of the cremation ash has taken many forms. By arrangement prior to death, many individuals have expressed their desire to have their ashes spread over certain areas of familiarity such as the mountains, the sea, from an airplane and the like. Obviously, in such circumstance, the storage of cremated ashes is no longer of concern.

However, many surviving family members choose to retain the cremated remains and memory of a loved one and must then find a suitable container for these mortal remains. Some choose to place the ashes in an urn or other enclosure and display or otherwise retain the filed enclosure in the household or other living accommodation. Others prefer to have the cremated remains placed in a more formal setting such as a crematorium or cemetery, a portion of which is set aside for dealing with these cremated remains.

A number of patented devices and arrangements are known to applicant for this general purpose of dealing with these cremated remains in a formal setting as follows:

| | |
|---|---|
| 3,076,292 | Arbogast |
| 4,023,316 | Martin |
| 4,521,999 | Flanagan |
| 4,607,417 | Hancovsky |
| 4,669,236 | Martin |
| 4,688,359 | See |
| 5,349,727 | Niebergall |
| 5,477,594 | LePage |

Of particular interest is U.S. Pat. No. 3,076,292 invented by Arbogast which generally teaches a free-standing wall structure defining a plurality of sealable cremation niches. U.S. Pat. No. 4,688,359 to See likewise teaches a storage and display system within a unique configured building or mausoleum having linear and columnar displays of arrays of transparent display vessels each having individual prominence and viewability and containing the cremated remains of a loved one.

Flanagan, in U.S. Pat. No. 4,521,999, teaches an interment arrangement for cremated remains having a massive foundation and creating the visual effect of a monolithic monument. Niebergall, in U.S. Pat. No. 5,349,727, has invented a storage container for cremation ashes having an outer decorative container and a hollow interior of generally rectangular shape. The container is formed of a transparent plastic material with sealable end caps so that the ashes can be contained within and displayed.

The present invention utilizes a well-known structure and manufacturing technique generally in the form of a concrete building block previously known as cinder block and formed of cured aggregate concrete material and preferably having the same size and shape as the conventional concrete building block. Mortal cremation remains are then deposited into a cavity formed through an opening from the front upright surface of the concrete block, the opening then being closed with a matchingly sized decorative front face which is sealingly engaged onto the otherwise front open surface of the concrete block. A plastic liner which mates within the cavity is provided to enhance hermetic sealing of the contents after sealing the enclosure. A plurality of sealed cremation niches of the present invention may easily be stacked and formed into rows and columns of a wall of suitable size, aided in alignment by integrally cast outwardly extending spacer tabs formed into one horizontal and one side or end surface of each concrete block.

BRIEF SUMMARY OF THE INVENTION

This invention is directed to a cremation niche for holding the cremated remains of a deceased living being. The cremation niche includes a precast concrete block preferably having a rectangular size and consistency of a conventional cast building block such as a "cinder block". A cavity within the concrete block with access thereinto through an opening in the front upright surface of the concrete block provides access into the cavity for placing the cremated remains therein. A flat, rectangular front face block matches the dimensions of the front surface of the concrete block and is connectable thereto by fasteners. A seal between the face block and the front face of the concrete block seals the cavity and protects the cremated remains. A separate molded plastic liner fitted into the cavity further enhances a hermetic seal within the cavity. Spacer tabs formed into one horizontal surface and one end surface of the concrete block enhance ease of building a wall of the filled and sealed niches with precise spacing between niches.

It is therefore an object of this invention to provide a cremation niche for the mortal remains of a living being.

It is yet another object of this invention to provide a cremation niche formed of a manufacturing process used to form conventional concrete building blocks or "cinder blocks".

It is still another object of this invention to provide a cremation niche which is dimensionally equivalent to the conventional concrete building blocks and manufactured with the same material consistency and content.

It is still another object of this invention to provide a cremation niche which includes spacer tabs formed into at least two orthogonal surfaces for accurate spacing of rows adjacent sealed cremation niches into rows and columns of accurately and uniformly spaced arrangement to form a wall.

In accordance with these and other objects which will become apparent hereinafter, the instant invention will now be described with reference to the accompanying drawings.

BRIEF DESCRIPTION OF THE DRAWINGS

FIG. 1 is a perspective exploded view of the invention.

FIG. 2 is a vertical section view of FIG. 1.

FIG. 3 is a perspective exploded view of a plurality of the device shown in FIG. 1 arranged vertically in columns and horizontally in rows to form a display wall within a crematorium or the like.

DETAILED DESCRIPTION OF THE INVENTION

Figure 3:
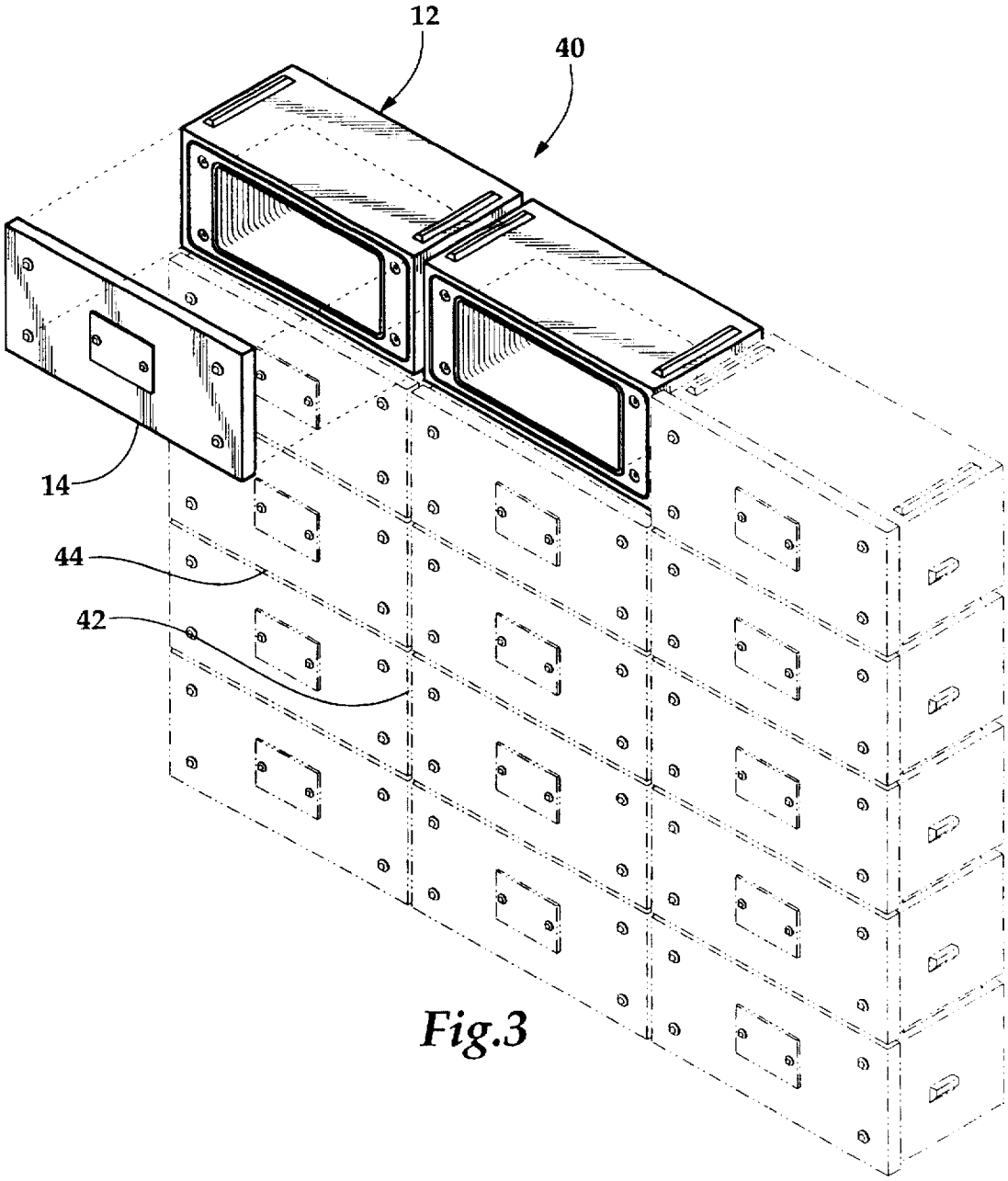

Referring now to the drawings, the invention is generally shown at numeral 10 and includes a precast concrete block 12 formed by the same process and having the same dimensions and material consistency and content as that of a conventional concrete building block used in building construction. The concrete block 12 thus generally has nominal overall dimensions of 8"×8"×16". Moreover, the manufacturing process of the concrete block 12 will be similar to that used for the concrete building blocks for both economy and rapidity of production.

The concrete block 12 includes a generally rectangular opening 25 which extends into a rectangularly shaped cavity 24 within the concrete block 12. A plastic liner 16 is preferably provided which closely mates against all interior surfaces of the cavity 24 to fully hermetically seal the interior wall surfaces of cavity 24. The liner 16 includes an outwardly extending flange 22 which mates against the front surface 22 of the concrete block 12.

A sealing O-ring 20 extending within a groove around the opening 25, provides a seal between the front surface 22 and a mating back surface of a face block 14 which is fabricated of rectangular rigid decorative material such as marble. The overall size of the face block 15 matches that of the front face 22 of the concrete block 12 (nominally 8"×16"). Fasteners 36 matably engage into plastic inserts 34 to tighten and retain the face block 14 in place against the O-ring seal 20.

A decorative name plate 18 connected to the front surface of the face block 14 by fasteners 38 serve to identify and memorialize the deceased person whose cremated ashes are hermetically interred within cavity 24.

The invention 10 is preferably intended to be used in plurality by forming rows and columns of sealed cremation niches 10 as shown in FIG. 2 in phantom and in perspective in FIG. 3. To facilitate precise arrangement and spacing between the individual sealed cremation niches 10 without the need for skilled brick layers, the concrete block 12 also includes molded outwardly extending tabs 26 and 28 on the exposed upper (or lower) surface of this concrete block 12 and laterally outwardly extending spacer tabs 30 on one upright end surface of the concrete block 12. The spacer tabs 26, 28, and 30, as best seen in FIG. 2 serve to accurately space adjacent and side-by-side and stacked niches 10 in the process of cementing them or otherwise connecting them together into the wall arrangement shown in FIG. 3 or other wall configuration as desired.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A cremation niche for storing cremation remains comprising:

a concrete masonry block as a single unit having an uninterrupted cross section which includes rectangular sides, top, bottom and back panels and an opening formed in a rectangular front surface thereof, said opening providing access into a hollow cavity substantially horizontally disposed within said concrete block;

a rigid rectangular decorative face block covering said opening and substantially mating with said front surface of said concrete block;

means connecting said face block against and substantially aligned with, said front surface after the cremation remains are placed into said cavity;

sealing means sealing said cavity against said front surface;

said concrete block having material consistency and overall outside dimensions substantially equal to those of a conventional concrete building block; and a spacer tab extending outwardly from said top or bottom panel and one said side panel and sized to space each said cremation niche apart from next above and adjacent cremation niches, respectively, when a plurality of said cremation niches are arranged to form an upright wall.

2. A cremation niche for storing cremation remains consisting of:

a concrete masonry block as a single unit having integrally cast formed rectangular sides, top, bottom and back panels defining an opening formed in a rectangular front surface thereof, said opening providing access into a hollow cavity extending substantially horizontal within said concrete block from said opening;

a rigid rectangular decorative face block covering said opening and substantially mating with said front surface of said concrete block;

means connecting said face block against and substantially aligned with, said front surface after the cremation remains are placed into said cavity;

sealing means sealing said cavity against said front surface;

a molded plastic liner snugly fit within and mate against each interior wall which defines said cavity; and spacer tabs extending outwardly from said top or bottom panel and one said side panel and sized to uniformly space said cremation niches apart.

* * * * *